US005667950A

United States Patent [19]

Schmidt

[11] Patent Number: 5,667,950

[45] Date of Patent: Sep. 16, 1997

[54] HIGH-CONTRAST PHOTOGRAPHIC ELEMENTS PROTECTED AGAINST HALATION

[75] Inventor: Ronald James Schmidt, Rochester, N.Y.

[73] Assignee: Eastman Kodak Company, Rochester, N.Y.

[21] Appl. No.: 748,963

[22] Filed: Nov. 13, 1996

Related U.S. Application Data

[63] Continuation of Ser. No. 557,213, Nov. 14, 1995, abandoned.

[51] Int. Cl.[6] ..... G03C 1/815; G03C 1/825

[52] U.S. Cl. ..... 430/510; 430/512; 430/517; 430/523; 430/524; 430/527; 430/530; 430/533; 430/931

[58] Field of Search ..... 430/510, 512, 430/517, 523, 524, 527, 530, 533, 931

[56] References Cited

U.S. PATENT DOCUMENTS

| | | | |
|---|---|---|---|
| 3,833,380 | 9/1974 | Crawford et al. | 430/523 |
| 4,394,441 | 7/1983 | Kawaguchi et al. | 430/530 |
| 4,418,141 | 11/1983 | Kawaguchi et al. | 430/530 |
| 4,495,276 | 1/1985 | Takimoto et al. | 430/527 |
| 4,847,180 | 7/1989 | Miyata et al. | 430/264 |
| 5,085,970 | 2/1992 | Kameoka et al. | 430/264 |
| 5,104,777 | 4/1992 | Schmidt et al. | 430/510 |
| 5,279,933 | 1/1994 | Gingello et al. | 430/509 |
| 5,294,525 | 3/1994 | Yamauchi et al. | 430/523 |
| 5,326,689 | 7/1994 | Murayama | 430/530 |
| 5,340,676 | 8/1994 | Anderson et al. | 430/63 |
| 5,368,995 | 11/1994 | Christian et al. | 430/530 |
| 5,372,921 | 12/1994 | Gingello et al. | 430/509 |
| 5,372,923 | 12/1994 | Kurachi et al. | 430/527 |
| 5,376,518 | 12/1994 | Jennings et al. | 430/534 |
| 5,380,584 | 1/1995 | Anderson et al. | 428/323 |
| 5,457,013 | 10/1995 | Christian et al. | 430/496 |
| 5,466,567 | 11/1995 | Anderson et al. | 430/530 |
| 5,484,694 | 1/1996 | Lelental et al. | 430/530 |

*Primary Examiner*—Geraldine Letscher

*Attorney, Agent, or Firm*—Alfred P. Lorenzo; J. Lanny Tucker

[57] ABSTRACT

High-contrast room-light-handleable contact-exposed ultraviolet-sensitive black-and-white silver halide photographic elements useful in the field of graphic arts are provided with an electrically-conductive layer which serves to provide antistatic protection. The electrically-conductive layer is comprised of electrically-conductive metal-containing particles, such as particles of antimony-doped tin oxide, a film-forming polymer, such as gelatin, and an ultraviolet-absorber, such as a solid particle filter dye, in an amount sufficient to provide halation protection.

20 Claims, No Drawings

HIGH-CONTRAST PHOTOGRAPHIC ELEMENTS PROTECTED AGAINST HALATION

This is a Continuation of application Ser. No. 08/557,213, filed 14, Nov. 1995, now abandonded.

FIELD OF THE INVENTION

This invention relates in general to photography and in particular to novel black-and-white silver halide photographic elements. More specifically, this invention relates to high-contrast room-light-handleable silver halide photographic elements which are especially useful in the field of graphic arts.

BACKGROUND OF THE INVENTION

High-contrast room-light-handleable black-and-white silver halide photographic elements are well known and widely used in graphic arts applications. The term "room-light-handleable" is intended to denote that the material can be exposed to a light level of 200 lux for several minutes without a significant loss in performance.

The silver halide emulsions utilized in high-contrast room-light-handleable photographic elements are slow speed emulsions, with the desired slow speed typically being achieved by the use of small grain sizes and by the doping of the silver halide grains with appropriate doping agents that control photographic speed. The incorporation of filter dyes in an overcoat layer of the photographic element to absorb unwanted light and decrease photographic speed is also a commonly employed technique.

Most commonly, the high-contrast room-light-handleable black-and-white silver halide photographic elements are ultraviolet-sensitive elements that are exposed by contact-exposure techniques. These photographic elements require a high degree of dimensional stability as well as a surface which is non-tacky and has a suitable degree of roughness to facilitate rapid vacuum draw-down during contact exposure.

An electrically-conductive layer comprised of electrically-conductive metal-containing particles dispersed in a film-forming polymer is advantageously incorporated in the aforesaid high-contrast room-light-handleable contact-exposed ultraviolet-sensitive photographic elements to provide process-surviving antistatic protection. However, such use of metal-containing particles can create an halation problem, i.e., a problem of image degradation resulting from unwanted reflections of light. It is believed that the halation problem results from the fact that the electrically-conductive layer forms two interfaces with significant index of refraction offsets, and therefore significant reflection of light during exposure. This "mirror-effect" causes unwanted halation with high-contrast room-light-handleable contact-exposed elements that do not contain an anti-halation underlayer. Increasing the concentration of metal-containing particles in the electrically-conductive layer beyond what is needed to obtain the desired level of electrical conductivity can serve to avoid this unwanted halation problem. This is apparently due to the action of the "excess" metal-containing particles in acting as an anti-halation agent. However, use of such high concentrations of metal-containing particles results in excessively high UV $D_{min}$ after processing, which creates problems in subsequent exposure steps.

The present invention is directed toward the objective of providing a high-contrast room-light-handleable contact-exposed ultraviolet-sensitive photographic element that combines effective antistatic protection with low UV $D_{min}$ and minimal halation.

SUMMARY OF THE INVENTION

In accordance with this invention, a high-contrast room-light-handleable contact-exposed ultraviolet-sensitive black-and-white silver halide photographic element is comprised of a support, a silver halide emulsion layer and an electrically-conductive layer and the electrically-conductive layer is comprised of electrically-conductive metal-containing particles dispersed in a film-forming polymer and contains an ultraviolet-absorber in an amount sufficient to provide halation protection.

In the photographic elements of this invention, the ultraviolet-asbsorber serves to absorb unwanted reflections of ultraviolet light coming from the interfaces of the electrically-conductive layer during contact exposure. Any compound that can be dispersed in the electrically-conductive layer and that provides a significant degree of ultraviolet absorption can be used for this purpose. By employing the ultraviolet-absorber and the electrically-conductive metal-containing particles in appropriate concentrations, the desired combination of effective antistatic protection, low UV $D_{min}$ and minimal halation is readily achieved.

DESCRIPTION OF THE PREFERRED EMBODIMENTS

The high-contrast room-light-handleable photographic elements of this invention can utilize any of the polymeric film supports known for use in the photographic arts. Typical of useful polymeric film supports are films of cellulose nitrate and cellulose esters such as cellulose triacetate and diacetate, polystyrene, polyamides, homo- and co-polymers of vinyl chloride, poly(vinylacetal), polycarbonate, homo- and co-polymers of olefins, such as polyethylene and polypropylene and polyesters of dibasic aromatic carboxylic acids with divalent alcohols, such as poly(ethylene terephthalate).

Polyester films, such as films of polyethylene terephthalate, have many advantageous properties, such as excellent strength and dimensional stability, which render them especially advantageous for use as supports in the present invention.

The polyester film supports which can be advantageously employed in this invention are well known and widely used materials. Such film supports are typically prepared from high molecular weight polyesters derived by condensing a dihydric alcohol with a dibasic saturated fatty carboxylic acid or derivatives thereof. Suitable dihydric alcohols for use in preparing polyesters are well known in the art and include any glycol, wherein the hydroxyl groups are on the terminal carbon atom and which contains from 2 to 12 carbon atoms such as, for example, ethylene glycol, propylene glycol, trimethylene glycol, hexamethylene glycol, decamethylene glycol, dodecamethylene glycol, and 1,4-cyclohexane dimethanol. Dibasic acids that can be employed in preparing polyesters are well known in the art and include those dibasic acids containing from 2 to 16 carbon atoms. Specific examples of suitable dibasic acids include adipic acid, sebacic acid, isophthalic acid, and terephthalic acid. The alkyl esters of the above-enumerated acids can also be employed satisfactorily. Other suitable dihydric alcohols and dibasic acids that can be employed in preparing polyesters from which sheeting can be prepared are described in J. W. Wellman, U.S. Pat. No. 2,720,503, issued Oct. 11, 1955.

Specific preferred examples of polyester resins which, in the form of sheeting, can be used in this invention are poly(ethylene terephthalate), poly(cyclohexane 1,4-dimethylene terephthalate), and the polyester derived by reacting 0.83 mol of dimethyl terephthalate, 0.17 mol of dimethyl isophthalate and at least one mol of 1,4-cyclohexanedimethanol. U.S. Pat. No. 2,901,466 discloses polyesters prepared from 1,4-cyclohexanedimethanol and their method of preparation.

The thickness of the polyester sheet material employed in carrying out this invention is not critical. For example, polyester sheeting of a thickness of from about 0.05 to about 0.25 millimeters can be employed with satisfactory results.

In a typical process for the manufacture of a polyester photographic film support, the polyester is melt extruded through a slit die, quenched to the amorphous state, oriented by transverse and longitudinal stretching, and heat set under dimensional restraint. In addition to being directionally oriented and heat set, the polyester film can also be subjected to a subsequent heat relax treatment to provide still further improvement in dimensional stability and surface smoothness.

The photographic elements of this invention are high contrast materials with the particular contrast value, as indicated by gamma ($\gamma$), depending on the type of emulsion employed. Gamma is a measure of contrast that is well known in the art as described for example, in James, *The Theory of the Photographic Process,* 4th Ed., 502, MacMillan Publishing Co., 1977.

The useful silver halide emulsions for use in this invention include silver chloride, silver bromide, silver chlorobromide, silver bromoiodide, silver chloroiodide and silver chlorobromoiodide emulsions. Preferably the emulsions are high chloride emulsions in which the silver halide grains are at least 80 mole percent chloride. Most preferably, the emulsions are one hundred percent silver chloride.

The silver halide emulsions utilized in this invention typically employ silver halide grains in which a doping agent has been incorporated to control the speed. Such use of doping agents is very well known in the photographic art. The doping agents are typically added during the crystal growth stages of emulsion preparation, for example, during initial precipitation and/or physical ripening of the silver halide grains. Rhodium is a particularly well known doping agent, and can be readily incorporated in the grains by use of suitable salts such as rhodium trichloride. Other particularly useful doping agents include iridium, ruthenium, rhenium, chromium and osmium.

McDugle et al U.S. Pat. No. 4,933,272, issued Jun. 12, 1990, the disclosure of which is incorporated herein by reference, discloses silver halide emulsions comprised of radiation sensitive silver halide grains exhibiting a face centered cubic crystal lattice structure internally containing a nitrosyl or thionitrosyl coordination ligand and a transition metal chosen from groups 5 to 10 inclusive of the periodic table of elements. These emulsions are preferred for use in the high-contrast room-light-handleable photographic elements of this invention.

In accordance with the aforesaid U.S. Pat. No. 4,933,272, the dopants contained within the silver halide grains are transition metal coordination complexes which contain one or more nitrosyl or thionitrosyl ligands. These ligands have the formula:

$$-\overset{\overset{\displaystyle X}{\|}}{N}-$$

where X is oxygen in the case of nitrosyl ligands and sulfur in the case of thionitrosyl ligands.

Preferred dopants utilized in this invention are transition metal coordination complexes having the formula:

$$[M(NX)(L)_5]_n$$

wherein:

M is a ruthenium, rhenium, chromium, osmium or iridium transition metal;

X is oxygen or sulfur;

L is a ligand; and n is -1, -2, or -3.

As in the aforesaid U.S. Pat. No. 4,933,272, all references herein to periods and groups within the periodic table of elements are based on the format of the periodic table adopted by the American Chemical Society and published in the *Chemical and Engineering News*, Feb. 4, 1985, p. 26. In this form the prior numbering of the periods was retained, but the Roman numeral numbering of groups and designations of A and B groups (having opposite meanings in the U.S. and Europe) was replaced by a simple left to right 1 through 18 numbering of the groups.

In addition to the doped silver halide grains, the silver halide emulsions employed in this invention also contain a hydrophilic colloid that serves as a binder or vehicle. The proportion of hydrophilic colloid can be widely varied, but typically is within the range of from about 20 to 250 g/mole silver halide. The presence of excessive levels of hydrophilic colloid can reduce maximum image density and, consequently, contrast. Thus, for $\gamma$ values of 10 or more, the vehicle is preferably present at a level of less than 200 g/mole silver halide.

The hydrophilic colloid is preferably gelatin, but many other suitable hydrophilic colloids are also known to the photographic art and can be used alone or in combination with gelatin. Suitable hydrophilic colloids include naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin, and the like.

In addition to the hydrophilic colloid and the silver halide grains, the radiation-sensitive silver halide emulsion layers employed in this invention can include a polymer latex which serves to improve the dimensional stability of the film. Polymers usable in latex form for this purpose are very well known in the photographic art. The requirements for such a polymer latex are (1) that it not interact with the hydrophilic colloid such that normal coating of the emulsion layer is not possible, (2) that it have optical properties, i.e., refractive index, similar to that of the hydrophilic colloid, and (3) that it have a glass transition temperature such that it is plastic at room temperature. Preferably, the glass transition temperature is below 20° C.

The polymer latex useful in the present invention is an aqueous dispersion of a water-insoluble polymer. It is incorporated in an emulsion layer in an amount that is typically in the range of from about 0.2 to about 1.5 parts per part by weight of the hydrophilic colloid.

The synthetic polymeric latex materials referred to herein are generally polymeric materials which are relatively insoluble in water compared to water-soluble polymers, but have sufficient water solubility to form colloidal suspensions of small polymeric micelles. Typical latex polymeric materials can be made by rapid copolymerization with vigorous agitation in a liquid carrier of at least one monomer which would form a hydrophobic homopolymer. In certain preferred embodiments, from about 1 to about 30 percent, by weight, of units of monomer containing the water-solubilizing group is present in the copolymer product. Copolymers prepared by this method and analogous methods provide discrete micelles of the copolymer which have low viscosities in aqueous suspensions. Typical useful copolymers include interpolymers of acrylic esters and sulfoesters as disclosed in Dykstra, U.S. Pat. No. 3,411,911, issued Nov. 19, 1968, interpolymers of acrylic esters and sulfobetains as described in Dykstra and Whiteley, U.S. Pat. No. 3,411,912, issued Nov. 19, 1968, interpolymers of alkyl acrylates and acrylic acids as disclosed in Ream and Fowler, U.S. Pat. No. 3,287,289, issued Nov. 22, 1966, interpolymers of vinyl acetate, alkyl acrylates and acrylic acids as disclosed in Corey, U.S. Pat. No. 3,296,169, and interpolymers as disclosed in Smith, U.S. Pat. No. 3,459,790, issued Aug. 5, 1969. Polymeric latex materials can also be made by rapid polymerization with vigorous agitation of hydrophobic polymers when polymerized in the presence of high concentrations of surfactants which contain water-solubilizing groups. The surfactants are apparently entrained in the micelle and the solubilizing group of the surfactant provides sufficient compatibility with aqueous liquids to provide a dispersion very much like a soap. Generally good latex materials are also disclosed in Nottorf, U.S. Pat. No. 3,142,568, issued Jul. 28, 1964; White, U.S. Pat. No. 3,193,386, issued Jul. 6, 1965; Houck et al, U.S. Pat. No. 3,062,674, issued Nov. 6, 1962; and Houck et al, U.S. Pat. No. 3,220,844, issued Nov. 30, 1965.

The synthetic polymeric latex materials are generally polymerized in a manner to produce micelles of about 1.0 micron average diameter or smaller to be highly useful in photographic emulsions and preferably the discrete micelles are less than 0.3 micron in average diameter. Generally, the micelles can be observed by photomicrographs when incorporated in gelatino emulsions, however, it is understood that some coalescing can occur when the emulsions are coated and dried.

In one embodiment, the latex polymers which can be used according to this invention are acrylic interpolymers, i.e., those interpolymers prepared from polymerizable acrylic monomers containing the characteristic acrylic group

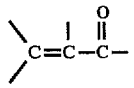

Such polymers are conveniently prepared by the interpolymerization of an acrylic monomer with at least one dissimilar monomer which can be another acrylic monomer or some other different polymerizable ethylenically unsaturated monomer. It is, of course, understood that the acrylic interpolymers employed in the practice of this invention are compatible with gelatin and have a Tg (glass transition temperature) of less than 20° C. (Tg can be calculated by differential thermal analysis as disclosed in "Techniques and Methods of Polymer Evaluation", Vol. 1, Marcel Dekker, Inc., New York, 1966).

A particularly preferred polymer latex for use in a silver halide emulsion layer is poly(methylacrylate-co-2-acrylamido-2-methyl propane sulfonic acid) which is comprised of repeating units of the formula:

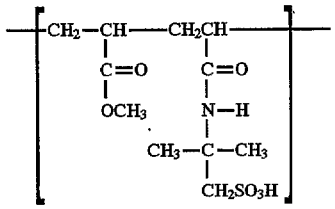

The thickness of the radiation-sensitive silver halide emulsion layers in the photographic elements of this invention is typically in the range of from about 1 to about 9 microns, and more preferably in the range of from about 2 to about 4 microns.

In addition to silver halide grains, a hydrophilic colloid and a polymer latex, the radiation-sensitive layers employed in the photographic elements of this invention can contain an effective amount of a hydrazine compound which functions as a nucleating agent. As an alternative to incorporation in one or more radiation-sensitive layers, the hydrazine compound can be incorporated in a layer contiguous thereto. Any hydrazine compound that functions as a nucleator and is capable of being incorporated in a silver halide emulsion layer, or a layer contiguous thereto, can be used in the practice of this invention. Hydrazine compounds can, of course, be included both in the silver halide emulsion layers and in one or more other layers of the photographic element.

Preferred photographic elements within the scope of this invention include elements containing a hydrazine compound of the formula:

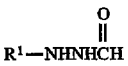

wherein $R^1$ is a phenyl nucleus having a Hammett sigma value-derived electron withdrawing characteristic of less than +0.30.

In the above formula, $R^1$ can take the form of a phenyl nucleus which is either electron donating (electropositive) or electron withdrawing (electronegative); however, phenyl nuclei which are highly electron withdrawing produce inferior nucleating agents. The electron withdrawing or electron donating characteristic of a specific phenyl nucleus can be assessed by reference to Hammett sigma values. The phenyl nucleus can be assigned a Hammett sigma value-derived electron withdrawing characteristic which is the algebraic sum of the Hammett sigma values of its substituents (i.e., those of the substituents, if any, to the phenyl group). For example, the Hammett sigma values of any substituents to the phenyl ring of the phenyl nucleus can be determined algebraically simply by determining from the literature the known Hammett sigma values for each substituent and obtaining the algebraic sum thereof. Electron donating substituents are assigned negative sigma values. For example, in one preferred form, $R^1$ can be a phenyl group which is unsubstituted. The hydrogens attached to the phenyl ring each have a Hammett sigma value of 0 by definition. In another form, the phenyl nuclei can include halogen ring substituents. For example, ortho- or para-chloro or fluoro substituted phenyl groups are specifically contemplated, although the chloro and fluoro groups are each mildly electron withdrawing.

Preferred phenyl group substituents are those which are not electron withdrawing. For example, the phenyl groups can be substituted with straight or branched chain alkyl groups (e.g., methyl, ethyl, n-propyl, isopropyl, n-butyl, isobutyl, n-hexyl, n-octyl, tert-octyl, n-decyl, n-dodecyl and similar groups). The phenyl groups can be substituted with alkoxy groups wherein the alkyl moieties thereof can be chosen from among the alkyl groups described above. The phenyl groups can also be substituted with acylamino groups. Illustrative acylamino groups include acetylamino, propanoylamino, butanoylamino, octanoylamino, benzoylamino, and similar groups.

In one particularly preferred form the alkyl, alkoxy and/or acylamino groups are in turn substituted with a conventional photographic ballast, such as the ballasting moieties of incorporated couplers and other immobile photographic emulsion addenda. The ballast groups typically contain at least eight carbon atoms and can be selected from both aliphatic and aromatic relatively unreactive groups, such as alkyl, alkoxy, phenyl, alkylphenyl, phenoxy, alkylphenoxy and similar groups.

The alkyl and alkoxy groups, including ballasting groups, if any, preferably contain from 1 to 20 carbon atoms, and the acylamino groups, including ballasting groups, if any, preferably contain from 2 to 21 carbon atoms. Generally, up to about 30 or more carbon atoms in these groups are contemplated in their ballasted form. Methoxyphenyl, tolyl (e.g., p-tolyl and m-tolyl) and ballasted butyramidophenyl nuclei are specifically preferred.

Examples of the specifically preferred hydrazine compounds are the following:

1-Formyl-2-(4-[2-(2,4-di-tert-pentylphenoxy)-butyramido]phenyl)hydrazine

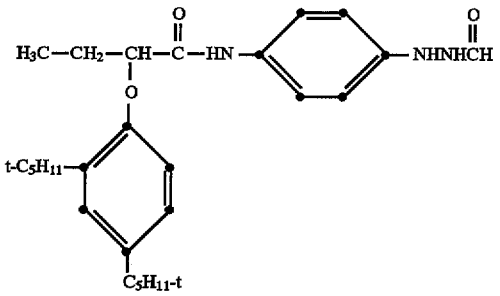

1-Formyl-2-phenylhydrazine

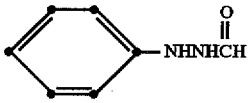

1-Formyl-2-(4-methoxylphenyl)hydrazine

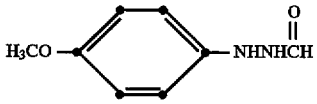

1-Formyl-2-(4-chlorophenyl)hydrazine

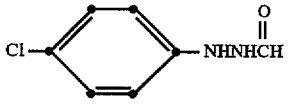

1-Formyl-2-(4-fluorophenyl)hydrazine

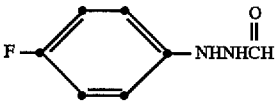

1Formyl-2-(2-chlorophenyl)hydrazine

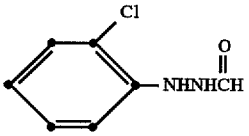

1-Formyl-2-(p-tolyl )hydrazine

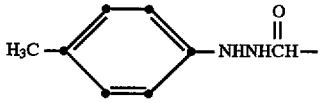

Preferred photographic elements within the scope of this invention also include those in which the hydrazide comprises an adsorption promoting moiety. Hydrazides of this type contain an unsubstituted or mono-substituted divalent hydrazo moiety and an acyl moiety. The adsorption promoting moiety can be chosen from among those known to promote adsorption of photographic addenda to silver halide grain surfaces. Typically, such moieties contain a sulfur or nitrogen atom capable of complexing with silver or otherwise exhibiting an affinity for the silver halide grain surface. Examples of preferred adsorption promoting moieties include thioureas, heterocyclic thioamides and triazoles. Exemplary hydrazides containing an adsorption promoting moiety include:

1-[4-(2-formylhydrazino)phenyl]-3-methyl thiourea

3-[4-(2-formylhydrazino)phenyl-5-(3-methyl-2-benzoxazolinylidene)rhodanine-6-([4-(2-formylhydrazino)phenyl]ureylene)-2-methylbenzothiazole N-(benzotriazol-5-yl)-4-(2-formylhydrazino)-phenylacetamide N-(benzotriazol-5-yl)-3-(5-formylhydrazino-2-methoxyphenyl)propionamide and N-2-(5,5-dimethyl-2-thiomidazol-4-yl-idenimino)ethyl-3-[5-(formylhydrazino)-2-methoxyphenyl]propionamide.

Hydrazine compounds incorporated in the photographic element are typically employed in a concentration of from about $10^{-4}$ to about $10^{-1}$ mole per mole of silver, more preferably in an amount of from about $5\times10^{-4}$ to about $5\times10^{-2}$ mole per mole of silver, and most preferably in an amount of from about $8\times10^{-4}$ to about $5\times10^{-3}$ mole per mole of silver. The hydrazines containing an adsorption promoting moiety can be used at a level as low as about $5\times10^{-6}$ mole per mole of silver.

An especially preferred class of hydrazine compounds for use in the elements of this invention are the hydrazine compounds described in Machonkin et al, U.S. Pat. No.

4,912,016 issued Mar. 27, 1990. These compounds are aryl hydrazides of the formula:

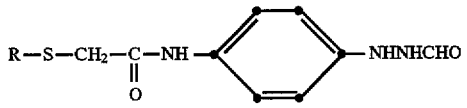

where R is an alkyl or cycloalkyl group.

Another especially preferred class of hydrazine compounds for use in the elements of this invention are the hydrazine compounds described in Looker et al, U.S. Pat. No. 5,104,769, issued Apr. 14, 1992.

The hydrazine compounds described in the aforesaid U.S. Pat. No. 5,104,769 have one of the following structural formulae:

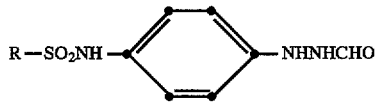

I or

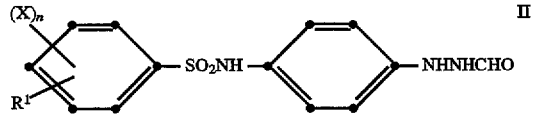

II wherein;

R is alkyl having from 6 to 18 carbon atoms or a heterocylic ring having 5 or 6 ring atoms, including ring atoms of sulfur or oxygen;

$R^1$ is alkyl or alkoxy having from 1 to 12 carbon atoms;

X is alkyl, thioalkyl or alkoxy having from 1 to about 5 carbon atoms; halogen; or —$NHCOR^2$, —$NHSO_2R^2$, —$CONR^2R^3$ or —$SO_2R^2R^3$ where $R^2$ and $R^3$, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to about 4 carbon atoms, halogen atoms (e.g. chlorine and fluorine) or —$NHCOR^2$ or —$NHSO_2R^2$ where $R^2$ is as defined above. Preferred R alkyl groups contain from about 8 to about 16 carbon atoms since alkyl groups of this size impart a greater degree of insolubility to the hydrazide nucleating agents and thereby reduce the tendency of these agents to be leached during development from the layers in which they are coated into developer solutions.

Heterocyclic groups represented by R include thienyl and furyl, which groups can be substituted with alkyl having from 1 to about 4 carbon atoms or with halogen atoms, such as chlorine.

Alkyl or alkoxy groups represented by $R^1$ can be straight or branched chain and can be substituted or unsubstituted. Substituents on these groups can be alkoxy having from 1 to about 4 carbon atoms, halogen atoms (e.g. chlorine or fluorine); or —$NHCOR^2$— or —$NHSO_2R^2$ where $R^2$ is as defined above. Preferred alkyl or alkoxy groups contain from 1 to 5 carbon atoms in order to impart sufficient insolubility to the hydrazide nucleating agents to reduce their tendency to being leached out of the layers in which they are coated by developer solution.

Alkyl, thioalkyl and alkoxy groups which are represented by X contain from 1 to about 5 carbon atoms and can be straight or branched chain. When X is halogen, it may be chlorine, fluorine, bromine or iodine. Where more than one X is present, such substituents can be the same or different.

Yet another especially preferred class of hydrazine compounds are aryl sulfonamidophenyl hydrazides containing ethyleneoxy groups which have the formula:

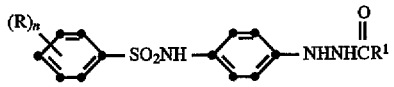

II where each R is a monovalent group comprised of at least three repeating ethyleneoxy units, n is 1 to 3, and $R^1$ is hydrogen or a blocking group. These compounds are described in Machonkin et al, U.S. Pat. No. 5,041,355, issued Aug. 20, 1991.

Still another especially preferred class of hydrazine compounds are aryl sulfonamidophenyl hydrazides containing both thio and ethyleneoxy groups which have the formula:

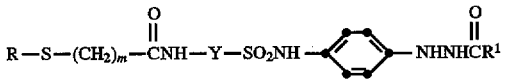

where R is a monovalent group comprised of at least three repeating ethyleneoxy units, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl. These compounds are described in Machonkin et al, U.S. Pat. No 4,988,604, issued Jan. 29, 1991.

Still another preferred class of hydrazine compounds for use in the elements of this invention are aryl sulfonamidophenyl hydrazides containing an alkyl pyridinium group Which have the formula:

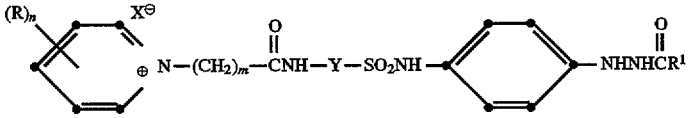

where each R is an alkyl group, preferably containing 1 to 12 carbon atoms, n is 1 to 3, X is an anion such as chloride or bromide, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl. Preferably, the sum of the number of carbon atoms in the alkyl groups represented by R is at least 4 and more preferably at least 8. The blocking group represented by $R^1$ can be, for example:

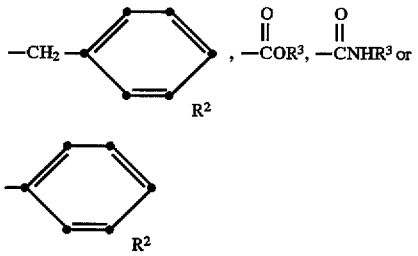

where $R^2$ is hydroxy or a hydroxy-substituted alkyl group having from 1 to 4 carbon atoms and $R^3$ is an alkyl group having from 1 to 4 carbon atoms. These compounds are described in Looker et al, U.S. Pat. No. 4,994,365, issued Feb. 19, 1991.

While certain preferred hydrazine compounds that are useful in this invention have been specifically described hereinabove, it is intended to include within the scope of this invention all hydrazine compound "nucleators" known to the art. Many such nucleators are described in "Development Nucleation By Hydrazine And Hydrazine Derivatives", Research Disclosure, Item 23510, Vol. 235, Nov. 10, 1983 and in numerous patents including U.S. Pat. Nos. 4,166,742, 4,168,977, 4,221,857, 4,224,401, 4,237,214, 4,241,164, 4,243,739, 4,269,929, 4,272,606, 4,272,614, 4,311,781, 4,332,878, 4,358,530, 4,377,634, 4,385,108, 4,429,036, 4,447,522, 4,540,655, 4,560,638, 4,569,904, 4,618,572, 4,619,886, 4,634,661, 4,650,746, 4,681,836, 4,686,167, 4,699,873, 4,722,884, 4,725,532, 4,737,442, 4,740,452, 4,912,016, 4,914,003, 4,988,604, 4,994,365, 5,041,355 and 5,104,767.

Halation is less of a problem with nucleated room-light-handleable photographic elements than with those that are not nucleated. The reason is that the chemical spread of nucleation provides much of the dot change needed. Therefore, the exposures required are reduced and halation is less of a problem. However, it is nonetheless advantageous to utilize an ultraviolet-absorber in the manner described herein with elements that are nucleated.

The total concentration of silver in the novel photographic elements of this invention is typically in the range of from about 0.5 to about 5.5 grams of silver per square meter, more preferably in the range of from about 1.5 to about 4.5 grams of silver per square meter, and most preferably in the range of from about 2.5 to about 3.5 grams of silver per square meter.

The amount of doping agent incorporated in the silver halide grains employed in this invention can vary over a wide range, as desired. Suitable amounts of doping agent for use in the silver halide grains of the imaging layer are typically in the range of from about 0.001 to about 2 millimoles per mole of silver halide.

An important feature of the present invention is the incorporation in the photographic element of an electrically-conductive layer that serves as an antistatic layer. The electrically-conductive layer is comprised of electrically-conductive metal-containing particles, a film-forming polymer and an ultraviolet-absorber. The ultraviolet-absorber is utilized in an amount sufficient to provide halation protection.

Any of the wide variety of electrically-conductive metal-containing particles proposed for use heretofore in imaging elements can be used in the electrically-conductive layer of this invention. Examples of useful electrically-conductive metal-containing particles include donor-doped metal oxides, metal oxides containing oxygen deficiencies, and conductive nitrides, carbides or borides. Specific examples of particularly useful particles include conductive $TiO_2$, $SnO_2$, $V_2O_5$, $Al_2O_3$, $ZrO_2$, $In_2O_3$, ZnO, $ZnSb_2O_6$, $InSbO_4$, $TiB_2$, $ZrB_2$, $NbB_2$, $TaB_2$, $CrB_2$, MoB, WB, $LaB_6$, ZrN, TiN, TiC, WC HfC, HfN and ZrC. Examples of patents describing these electrically-conductive particles include U.S. Pat. Nos. 4,275,103, 4,394,441, 4,416,963, 4,418,141, 4,431,764, 4,495,276, 4,571,361, 4,999,276, 5,122,445 and 5,368,995.

Particular preferred metal oxides for use in this invention are antimony-doped tin oxide, tin-doped indium oxide, aluminum-doped zinc oxide and niobium-doped titanium oxide.

In a particular embodiment of the present invention, the electrically-conductive metal-containing particles are particles of an electronically-conductive metal antimonate as described in U.S. Pat. No. 5,368,995.

In a further particular embodiment of the present invention, the electrically-conductive metal-containing particles are particles of antimony-doped tin oxide having an antimony dopant level of greater than 8 atom percent, an X-ray crystallite size of less than 100 Angstroms and an average equivalent circular diameter of less than 15 nanometers but no less than the X-ray crystallite size, as described in copending commonly-assigned U.S. patent application Ser. No. 342,959, filed Nov. 21, 1994, "Imaging Element Comprising An Electrically-Conductive Layer Containing Antimony-Doped Tin Oxide Particles" by Mark Lelental et al now U.S. Pat. No. 5,484,694, issued Jan. 16, 1996.

In the photographic elements of this invention, the electrically-conductive metal-containing particles preferably have an average particle size of less than one micrometer, more preferably of less than 0.3 micrometers, and most preferably of less than 0.1 micrometers. It is also advantageous that the electrically-conductive metal-containing particles exhibit a powder resistivity of $10^5$ ohm-centimeters or less, more preferably less than $10^3$ ohm-centimeters and most preferably less than $10^2$ ohm-centimeters.

The electrically-conductive metal-containing particles are preferably incorporated in the electrically-conductive layer in an amount of from about 100 to about 350 milligrams per square meter, and more preferably from about 150 to about 300 milligrams per square meter.

Film-forming polymers useful in the electrically-conductive layer of this invention include water-soluble polymers such as gelatin, gelatin derivatives and maleic acid anhydride copolymers; cellulose compounds such as carboxymethyl cellulose, hydroxyethyl cellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamides, their derivatives and partially hydrolyzed products, vinyl polymers and copolymers such as polyvinyl acetate and polyacrylate acide esters; derivatives of the above polymers; and other synthetic resins. Other suitable film-formers include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, olefins, and aqueous dispersions of polyurethanes.

In the electrically-conductive layer of this invention, the electrically-conductive metal-containing particles are preferably incorporated in a volumetric proportion sufficient to provide a resistivity of less than $1\times10^{12}$ ohms/square and more preferably of less than $1\times10^{9}$ ohms/square. The electrically-conductive metal-containing particles preferably constitute 20 to 80 percent by volume and most preferably 50 to 80 percent by volume of the electrically-conductive layer.

It is known to incorporate a wide variety of addenda in the electrically-conductive layer of imaging elements. Thus, for example, U.S. Pat. No. 5,368,995, which relates to the use of electronically-conductive metal antimonates, includes the following description:

"In addition to binders and solvents, other components that are well known in the photographic art may also be present in the electrically-conductive layer. These additional components include: surfactants and coating aids, thickeners, crosslinking agents or hardeners, soluble and/or solid particle dyes, antifoggants, matte beads, lubricants, and others."

However, it was not heretofore known to incorporate an ultraviolet-absorber in an electrically-conductive layer of a high-contrast room-light-handleable contact-exposed ultraviolet-sensitive black-and-white photographic element for the purpose of providing protection against halation that is caused by electrically-conductive metal-containing particles.

Any of the wide variety of ultraviolet-absorbing agents known to the art can be used in the present invention as a means of reducing halation. Thus, for example, water-soluble dyes can be used for this purpose. Such dyes should be incorporated in the electrically-conductive layer with a mordant to prevent dye diffusion.

Useful water-soluble dyes for the purpose of this invention include the pyrazolone oxonol dyes of U.S. Pat. No. 2,274,782, the solubilized diaryl azo dyes of U.S. Pat. No. 2,956,879, the solubilized sytyrl and butadienyl dyes of U.S. Pat. Nos. 3,423,207 and 3,384,487, the merocyanine dyes of U.S. Pat. No 2,527,583, the merocyanine and oxonol dyes of U.S. Pat. Nos. 3,486,897, 3,652,284 and 3,718,472, the enamino hemioxonol dyes of U.S. Pat. No. 3,976,661, the cyanomethyl sulfone-derived merocyanines of U.S. Pat. No. 3,723,154, the thiazolidones, benzotriazoles, and thiazolothiazoles of U.S. Pat. Nos. 2,739,888, 3,253,921, 3,250,617, and 2,739,971, the triazoles of U.S. Pat. No. 3,004,896, and the hemioxonols of U.S. Pat. Nos. 34,215,597 and 4,045, 229. Useful mordants are described, for example, in U.S. Pat. 3,282,699, 3,455,693, 3,438,779, and 3,795,519.

In a preferred embodiment of the present invention, the ultraviolet-absorber is a solid particle filter dye as described in U.S. Pat. No. 4,940,654. The use of such dyes is preferred because they are immobile yet can be readily washed out of the element during processing. These filter dyes are compounds represented by the formula(I):

$$[D—A)_y]—X_n \qquad (I)$$

where

D is a chromophoric light-absorbing moiety, which, when y is 0, comprises an aromatic ring free of carboxy substituents, A is an aromatic ring, free of carboxy substituents, bonded directly or indirectly to D, X is a substituent, other than carboxy, having an ionizable proton, either on A or on an aromatic ring portion of D, having a pKa of about 4 to 11 in a 50/50 mixture (volume basis) of ethanol and water, y is 0 to 4, n is 1 to 7, and the compound has a log partition coefficient of from about 0 to 6 when it is in unionized form.

Examples of filter dyes according to formula (I) include the following:

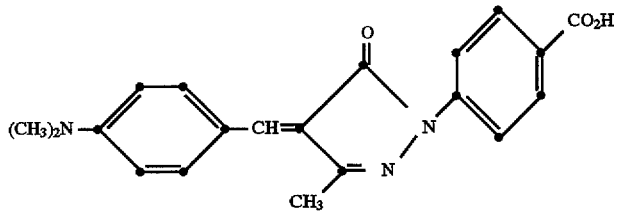

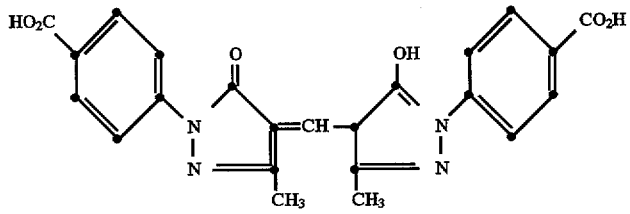

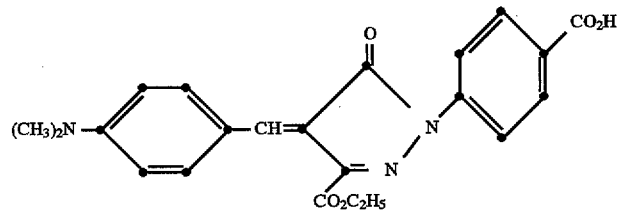

-continued

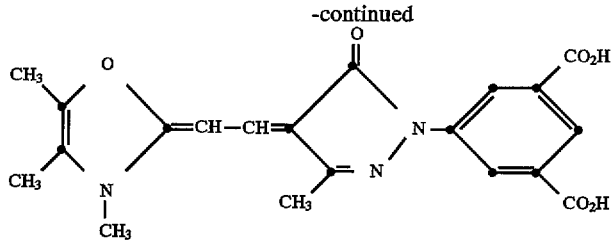

(4)

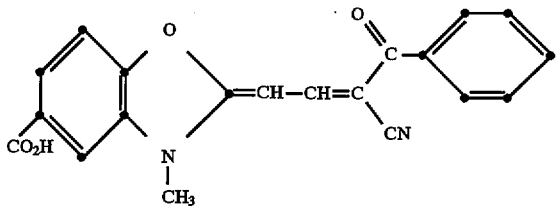

(5)

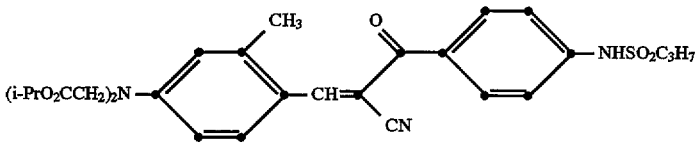

(6)

The amount of ultraviolet-absorber incorporated in the electrically-conductive layer can be any amount which is effective to reduce halation. Preferred amounts range from about 1 to about 100 milligrams per square meter, while particularly preferred amounts range from about 4 to about 25 milligrams per square meter.

The novel photographic elements of this invention can include an overcoat layer containing a hydrophilic colloid and a matting agent. The hydrophilic colloid can be selected from among those described above as being useful in the emulsion layer. Most preferably, the hydrophilic colloid in the overcoat layer is gelatin.

Discrete solid particles of a matting agent, typically having an average particle size in the range of from about 1 to about 5 microns and preferably in the range of from about 2 to 4 microns, can be utilized in the overcoat layer. The matting agent is typically employed in an amount of from about 0.02 to about 1 part per part by weight of the hydrophilic colloid. Either organic or inorganic matting agents can be used. Examples of organic matting agents are particles, often in the form of beads, of polymers such as polymeric esters of acrylic and methacrylic acid, e.g., poly (methylmethacrylate), cellulose esters such as cellulose acetate propionate, cellulose ethers, ethyl cellulose, polyvinyl resins such as poly(vinyl acetate), styrene polymers and copolymers, and the like. Examples of inorganic matting agents are particles of glass, silicon dioxide, titanium dioxide, magnesium oxide, aluminum oxide, barium sulfate, calcium carbonate, and the like. Matting agents and the way they are used are further described in U.S. Pat. Nos. 3,411,907 and 3,754,924.

Particles used as matting agents in the present invention can be of essentially any shape. Their size is typically defined in terms of mean diameter. Mean diameter of a particle is defined as the diameter of a spherical particle of identical mass. Polymer particles that are in the form of spherical beads are preferred for use as matting agents.

The thickness of the overcoat layer is typically in the range of from about 0.2 to about 1 micron, preferably in the range of from about 0.3 to about 0.6 micron and most preferably in the range of from about 0.35 to about 0.45 micron.

The photographic elements of this invention which contain a hydrazine compound can be processed in developing solutions of the type which contain an amino compound which functions as a contrast-promoting agent or, as it is sometimes referred to, as a "booster." These are described in Nothnagle, U.S. Pat. No. 4,269,929, issued May 26, 1981. An example of this type of developing solution is KODAK ULTRATEC DEVELOPER. They can also be processed in conventional developing solutions which do not contain an amino compound which functions as a contrast-promoting agent. An example of this type of developing solution is KODAK UNIVERSAL RAPID ACCESS DEVELOPER.

The photographic elements of this invention can optionally contain an "incorporated booster." Amino compounds which are useful as incorporated boosters, i.e., boosters which are incorporated in the photographic element rather than in the developing solution, are described in Machonkin et al, U.S. Pat. No. 4,975,354, issued Dec. 4, 1990.

The amino compounds useful as "incorporated boosters" described in the aforesaid U.S. Pat. No. 4,975,354 are amino compounds which:

(1) comprise at least one secondary or tertiary amino group;

(2) contain within their structure a group comprised of at least three repeating ethyleneoxy units, and (3) have a partition coefficient, of at least one, preferably at least three, and most preferably at least four.

Included within the scope of the amino compounds utilized in this invention as "incorporated boosters" are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amino compounds employed in this invention as "incorporated boosters" are compounds of at least 20 carbon atoms.

Preferred amino compounds for use as "incorporated boosters" are bis-tertiary-amines which have a partition coefficient of at least three and a structure represented by the formula:

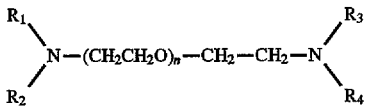

wherein n is an integer with a value of 3 to 50, and more preferably 10 to 50, $R_1$, $R_2$, $R_3$ and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another advantageous group of amino compounds for use as "incorporated boosters" are bis-secondary amines which have a partition coefficient of at least three and a structure represented by the formula:

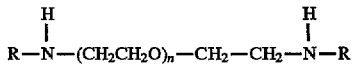

wherein n is an integer with a value of 3 to 50, and more preferably 10 to 50, and each R is, independently, a linear or branched, substituted or unsubstituted, alkyl group of at least 4 carbon atoms.

Preferably the group comprised of at least three repeating ethyleneoxy units is directly linked to a tertiary amino nitrogen atom and most preferably the group comprised of at least three repeating ethyleneoxy units is a linking group joining tertiary amino nitrogen atoms of a bis-tertiary-amino compound.

The amino compound utilized as an "incorporated booster" is typically employed in an amount of from about 1 to about 25 millimoles per mole of silver, and more preferably in an amount of from about 5 to about 15 millimoles per mole of silver.

Other amino compounds useful as "incorporated boosters" are described in Yagihara et al, U.S. Pat. No. 4,914,003 issued Apr. 3, 1990. The amino compounds described in this patent are represented by the formula:

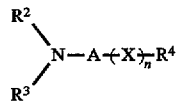

wherein $R^2$ and $R^3$ each represent a substituted or unsubstituted alkyl group or may be linked to each other to form a ring; $R^4$ represents a substituted or unsubstituted alkyl, aryl or heterocyclic group; A represents a divalent linkage; X represents —$CONR^5$—, —O—$CONR^5$, —$NR^5CONR^5$—, —$NR^5COO$—, —COO—, —OCO—, —CO—, —$NR^5CO$—, —$SO_2NR^5$—, —$NR^5SO_2$—, —SO— or —O— group in which $R^5$ represents a hydrogen atom or a lower alkyl group and n represents 0 or 1, with the proviso that the total number of carbon atoms contained in $R^2$, $R^3$, $R^4$ and A is 20 or more.

As lithographic-type photographic elements, the high-contrast room-light-handleable elements of this invention are preferably utilized (exposed and processed) as sheet films. As such, the films preferably have low curl (i.e., less than about 40 ANSI curl units at 21° C. and 15% relative humidity, using ANSI PH 1.29–1971, which calls for matching the curl of sample strips on a template of curves of varying radii to determine the radius of curvature and reporting the value of 100/R as the degree of curl where R is the radius of curvature in inches) and high dimensional stability (humidity coefficient, defined as % change in linear dimension divided by change in percent humidity over a 15–50% relative humidity range at 21° C., of less than about 0.0015).

In the examples reported hereinbelow, a developer concentrate was formulated as follows and diluted at a ratio of one part of concentrate to four parts of water to produce a working strength developing solution with a pH of 10.4.

| | |
|---|---|
| Sodium metabisulfite | 145 g |
| 45% Potassium hydroxide | 178 g |
| Diethylenetriamine pentaacetic acid pentasodium salt (40% solution) | 15 g |
| Sodium bromide | 12 g |
| Hydroquinone | 65 g |
| 1-Phenyl-4-hydroxymethyl-4-methyl-3-pyrazolidone | 2.9 g |
| Benzotriazole | 0.4 g |
| 1-Phenyl-5-mercaptotetrazole | 0.05 g |
| 50% Sodium hydroxide | 46 g |
| Boric acid | 6.9 g |
| Diethylene glycol | 120 g |
| 47% Potassium Carbonate | 120 g |
| Water to one liter | |

The invention is further illustrated by the following examples of its practice.

EXAMPLES 1 to 8

A silver halide photographic element, utilized as a control and referred to herein as Control 1, is comprised of a poly(ethylene terephthlate) film support coated on one side with a silver halide emulsion layer and a protective overcoat layer and on its opposite side with a backing layer. The silver halide emulsion layer is comprised of a negative-working silver chloride emulsion, doctored with 4-hydroxy-6-methyl-2-methylmercapto-1,3,3a,7-tetraazaindene, containing silver halide grains capable of forming a surface latent image. The silver halide grains are 100% chloride, have a mean grain size of 0.08 micrometers and a ruthenium content of 0.13 millimoles per mole of silver chloride. The silver chloride is present at a concentration of 2.6 grams of silver per square meter. The silver halide emulsion layer contains gelatin as a binder and a polymer latex, poly (methylacrylate-co-2-acrylamido-2-methyl propane sulfonic acid), to improve dimensional stability.

Control elements 2 to 7 were also prepared and evaluated in the same manner as control element 1. These elements differed from control element 1 in that they included an electrically-conductive layer beneath the emulsion layer. The electrically-conductive layer was comprised of antimony-doped tin oxide particles dispersed in gelatin. The antimony-doped tin oxide particles were obtained from Keeling & Walker, Ltd., under the designation CPM-375 and had an antimony content of 7.4 atom percent. The amount of antimony-doped tin oxide particles in milligrams per square meter that was utilized in each of control elements 2 to 7 is described in Table I.

Photographic elements within the scope of the present invention were prepared in each of examples 1 to 8. These elements differed from the control elements in that they additionally contained an ultraviolet-absorber in the electrically-conductive layer. In each case, the ultraviolet-absorber employed was the solid particle filter dye referred to hereinabove as filter dye (2).

The amount of both the ultraviolet-absorber and the antimony-doped tin oxide particles utilized in each of examples 1 to 8 is described in Table I.

Each of control elements 1 to 7 and each of the elements of examples 1 to 8 was developed with the use of the developing solution hereinabove described. The UV $D_{min}$ values specified in Table I are those of the processed elements.

One of the parameters referred to in Table I is identified as "Halation % Dot." This is the resultant percent dot when a 50 percent dot original is significantly overexposed. Measurements were made with an X-Rite 361 T densitometer. The examples utilized 20 times (or 1.3 log E) the exposure required to yield 55% dot with an original 50% dot pattern. Thus, Control 1, which employed no conductive particles, yielded a 66.8 "Halation % Dot" value, meaning that the 50% original grew from 55% to 66.8% with the 20× extra exposure. If there was no halation at all, the "Halation % Dot", obtained by multiplying the dot growth in the 50–55% range (6.5% dot/log E) by 1.3 log E and adding to 55% dot would be 63.5% dot. Thus, it is apparent that the support contributes some halation due to refractive index differences. Control 2 shows that at an antimony-doped tin oxide content of 200 mg/m$^2$ the "Halation % Dot" value is 75.5. Thus, the incorporation of the antimony-doped tin oxide causes a further departure from the optimum of 63.5%. Very high levels of antimony-doped tin oxide such as the 400 to 450 mg/m$^2$ levels of Controls 6 and 7 tend to correct the problem, with Control 7 and Control 1 being essentially the same. However, use of antimony-doped tin oxide at levels as high as Controls 6 and 7 has the disadvantages of high cost and high UV $D_{min}$. Examples 1 to 8 show that very small concentrations of ultraviolet absorber reduce the "Halation % Dot" to levels like that of Control 1 while greater amounts of ultraviolet-absorber approach the theoretical 63.5%. Use of an antihalation underlayer would be superior to incorporation of an ultraviolet absorber in the electrically-conductive layer, because the reflections from both interfaces of the electrically-conductive layer would be blocked. However, the added cost and complexity of including an antihalation underlayer outweighs this advantage, and incorporation of an ultraviolet-absorber in the electrically-conductive layer provides a low cost and highly effective solution to the problem without the need for an additional layer.

TABLE I

| Example Number | Concentration of Conductive Particles (mg/m$^2$) | Concentration of Ultraviolet Absorber (mg/m$^2$) | UV Dmin | Resistivity (log ohms/square) | Halation (% Dot) |
|---|---|---|---|---|---|
| Control 1 | 0 | 0 | 0.040 | 13.0 | 66.8 |
| Control 2 | 200 | 0 | 0.045 | 9.3 | 75.5 |
| Control 3 | 250 | 0 | 0.045 | 9.0 | 69.9 |
| Control 4 | 300 | 0 | 0.045 | 8.8 | 72.5 |
| Control 5 | 350 | 0 | 0.048 | 8.9 | 69.6 |
| Control 6 | 400 | 0 | 0.049 | 8.6 | 68.7 |
| Control 7 | 450 | 0 | 0.052 | 8.5 | 66.9 |
| 1 | 250 | 2 | 0.045 | 9.0 | 69.6 |
| 2 | 250 | 4 | 0.046 | 9.1 | 67.5 |
| 3 | 300 | 2 | 0.046 | 8.6 | 66.8 |
| 4 | 300 | 4 | 0.045 | 9.0 | 66.9 |
| 5 | 300 | 8 | 0.046 | 9.0 | 65.8 |
| 6 | 300 | 16 | 0.046 | 9.0 | 65.2 |
| 7 | 350 | 2 | 0.047 | 8.8 | 67.7 |
| 8 | 350 | 4 | 0.048 | 8.8 | 66.3 |

As shown by the data in Table I, the invention provides a combination of low UV Dmin, low resistivity and low halation that is not attainable with the control compositions. Thus, for example, control test 1 provides low UV Dmin and low halation but excessive resistivity, whereas Control test 7 provides low resistivity and low halation but excessive UV Dmin. The examples demonstrate a combination of UV Dmin, resistivity and halation that is acceptable for all three characteristics.

The invention has been described in detail with particular reference to preferred embodiments thereof, but it will be understood that variations and modifications can be effected within the spirit and scope of the invention.

I claim:

1. A high-contrast room-light-handleable contact-exposed ultraviolet-sensitive black-and-white silver halide photographic element; said element comprising:

(1) a support;

(2) a silver halide emulsion layer; and (3) an electrically-conductive layer, said electrically-conductive layer comprising electrically-conductive metal-containing particles, a film-forming polymer, and a separate ultraviolet-absorber in an amount sufficient to provide halation protection for said photographic element.

2. A photographic element as claimed in claim 1, wherein said support is a polyester film.

3. A photographic element as claimed in claim 1, wherein said support is a polyethylene terephthalate film.

4. A photographic element as claimed in claim 1, wherein the silver halide grains in said silver halide emulsion layer are at least 80 mole percent chloride.

5. A photographic element as claimed in claim 1, wherein the silver halide grains in said silver halide emulsion layer are one hundred percent chloride.

6. A photographic element as claimed in claim 1, wherein the silver halide grains in said silver halide emulsion layer are doped with a doping agent selected from the group consisting of rhodium, iridium, ruthenium, rhenium, chromium and osmium.

7. A photographic element as claimed in claim 1, wherein the silver halide grains in said silver halide emulsion layer are doped with a doping agent, containing a nitrosyl or thionitrosyl coordination ligand and a transition metal of groups 5 to 10 of the periodic table of elements, in an amount sufficient to provide a level of photosensitivity which permits room-light-handling of said element.

8. A photographic element as claimed in claim 1, additionally containing a hydrazine compound which functions as a nucleating agent.

9. A photographic element as claimed in claim 8, additionally containing an amino compound which functions as an incorporated booster.

10. A photographic element as claimed in claim 1, additionally comprising an overcoat layer containing a hydrophilic colloid and a matting agent.

11. A photographic element as claimed in claim 1, wherein said film-forming polymer is gelatin.

12. A photographic element as claimed in claim 1, wherein said electrically-conductive metal-containing particles are selected from the group consisting of donor-doped metal oxides, metal oxides containing oxygen deficiencies, conductive nitrides, conductive carbides and conductive borides.

13. A photographic element as claimed in claim 1, wherein said electrically-conductive metal-containing particles are selected from the group consisting of antimony-doped tin oxide, tin-doped indium oxide, aluminum-doped zinc oxide and niobium-doped titanium oxide.

14. A photographic element as claimed in claim 1, wherein said electrically-conductive metal-containing particles exhibit a powder resistivity of $10^5$ ohm-centimeters or less.

15. A photographic element as claimed in claim 1, wherein said electrically-conductive metal-containing particles constitute 20 to 80 percent by volume of said electrically-conductive layer.

16. A photographic element as claimed in claim 1, wherein said electrically-conductive layer has a resistivity of less than $1\times10^9$ ohms/square.

17. A high-contrast room-light-handleable contact-exposed ultraviolet-sensitive black-and-white silver halide photographic element; said element comprising:

(1) a support;

(2) a silver halide emulsion layer; and (3) an electrically-conductive layer, said electrically-conductive layer comprising electrically-conductive metal-containing particles, a film-forming polymer, and a solid particle filter dye ultraviolet-absorber in an amount sufficient to provide halation protection for said photographic element.

18. A photographic element as claimed in claim 17, wherein said solid particle filter dye is a compound of the formula:

$$[D—A)_y]—X_n$$

where

D is a chromophoric light-absorbing moiety, which, when y is 0, comprises an aromatic ring free of carboxy substituents, A is an aromatic ring, free of carboxy substituents, bonded directly or indirectly to D, X is a substituent, other than carboxy, having an ionizable proton, either on A or on an aromatic ring portion of D, having a pKa of about 4 to 11 in a 50/50 mixture (volume basis) of ethanol and water, y is 0 to 4, n is 1 to 7, and the compound has a log partition coefficient of from about 0 to 6 when it is in unionized form.

19. A photographic element as claimed in claim 17, wherein said solid particle filter dye is represented by one of the following formulae (1) to (6):

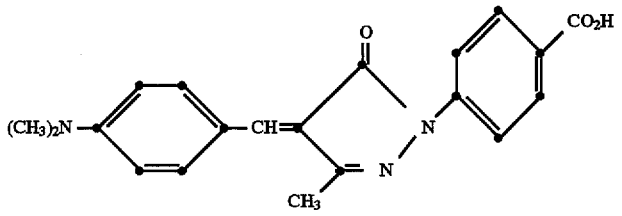

(1)

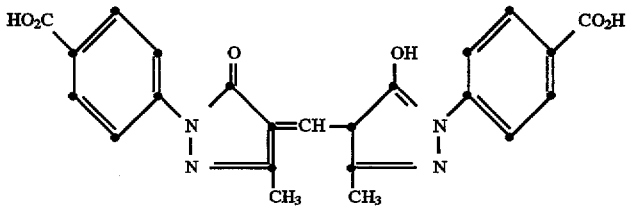

(2)

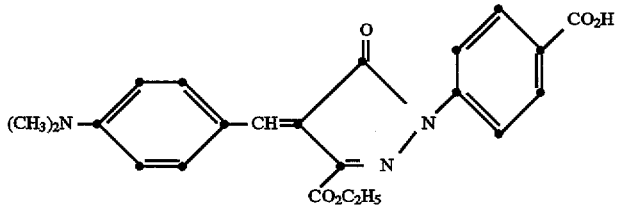

(3)

-continued
(4)
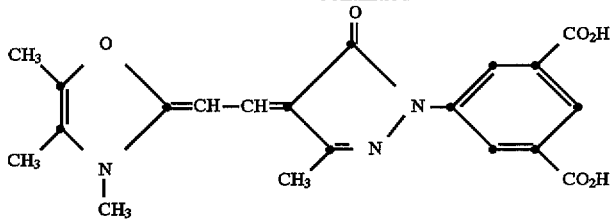
(5)
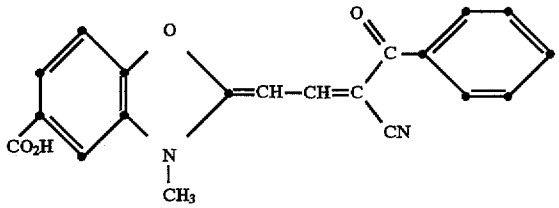
(6)
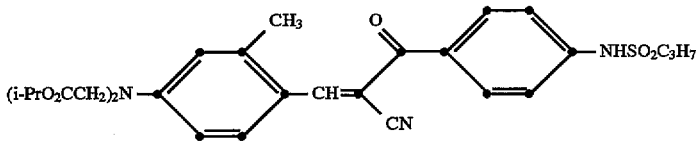
20. A photographic element as claimed in claim 1, wherein the amount of said ultraviolet-absorber is from about 1 to about 100 milligrams per square meter.
* * * * *